United States Patent [19]

Richardson

[11] Patent Number: 4,640,200

[45] Date of Patent: Feb. 3, 1987

[54] PASS-THROUGH TRANSACTION DRAWER WITH REMOVABLE DEAL TRAY

[75] Inventor: Daniel E. Richardson, St. Louis County, Mo.

[73] Assignee: Shure Manufacturing Corporation, St. Louis, Mo.

[21] Appl. No.: 619,383

[22] Filed: Jun. 11, 1984

[51] Int. Cl.[4] ..... E06B 7/32

[52] U.S. Cl. ..... 109/19; 232/43.2

[58] Field of Search ..... 109/5, 10, 19; 232/43.2, 43.4, 44

[56] References Cited

U.S. PATENT DOCUMENTS

| | | | |
|---|---|---|---|
| 1,654,692 | 1/1928 | Marois | 109/19 |
| 3,145,918 | 8/1964 | Higgins et al. | 109/19 |
| 3,390,833 | 7/1968 | Harris | 109/19 |
| 4,190,004 | 2/1980 | Richardson | 109/19 |
| 4,393,789 | 7/1983 | Glotfelter | 109/19 |

*Primary Examiner*—Thomas J. Holko
*Assistant Examiner*—Neill Wilson
*Attorney, Agent, or Firm*—Polster, Polster and Lucchesi

[57] ABSTRACT

A pass-through transaction drawer with a removable deal tray is disclosed thereby to permit the carrying out of transactions between an attendant or clerk within a building and a customer outside of the building. The tray is relatively shallow and facilitates transactions involving only the exchange of money or credit cards and relatively small articles and, when the tray is removed, permits the exchange of relatively larger, bulky items. The tray may only be removed by the attendant from within the building.

6 Claims, 9 Drawing Figures

PASS-THROUGH TRANSACTION DRAWER WITH REMOVABLE DEAL TRAY

BACKGROUND OF THE INVENTION

This invention relates to a pass-through transaction drawer such as is typically provided in a building, such as a service station attendant's booth, a convenience drive-up food store, or a walk-up bank teller window. Such transaction drawers are conventionally located immediately below a window behind which an attendant, clerk, or teller is stationed so as to permit the attendant to view the customer approaching his window and to personally transact business with the customer while the attendant, together with the cash register and money, remain securely locked within the building.

Reference may be made to U.S. Pat. No. 4,190,003 which discloses a prior art transaction drawer. This above-noted prior art transaction drawer has a relatively deep drawer which is selectively movable by the attendant from a retracted position in which the drawer is located within the building, in which a door closes the opening through the wall of the building, and in which the attendant has access to the interior of the movable transaction drawer. Further, the transaction drawer is movable from its retracted position to its extended position in which the door is opened and in which the drawer extends out beyond the wall of the building thereby to permit access to the interior of the drawer by a customer.

Generally, prior art transaction drawers were relatively deep drawers, as shown in the above-mentioned U.S. Pat. No. 4,190,003, which permitted the transfer of both cash, credit cards, change, and the like, and relatively large packages, such as cans of oil or beverages. However, other similar prior art transaction drawers were utilized which were relatively shallow and which permitted the transfer only of cash, credit cards, change, and small packages, such as a pack of cigarettes and the like.

There has been a long-standing need for a transaction drawer which has the convenience of a shallow-depth drawer for transferring cash, credit cards, and small items, but yet, when required, also enabled the transfer of relatively large, bulky packages, such as cans of oil or six-packs of beverages.

SUMMARY OF THE INVENTION

Among the several objects and features of the present invention may be noted the provision of a transaction drawer assembly which readily facilitates transactions only involving cash, credit cards, and small articles, and yet which also permits the transfer of relatively large, bulky packages, such as cans of oil or packages of beverages;

The provision of such a transaction drawer which may be readily installed in the wall of a building and which does not adversely affect the outward appearance of the building;

The provision of such a transaction drawer which, when closed, provides a relatively tight weather seal for the building;

The provision of such a transaction drawer which includes a cash box, the contents of which are concealed from the view of a customer outside the building when the cash box is open;

The provision of such a transaction drawer which, when closed, is positively locked in its closed position, preventing opening of the transaction drawer from the exterior of the building;

The provision of such a transaction drawer which, when open, severely limits access to the interior of the building by a person outside the building;

The provision of such a transaction drawer which, when closed, is tamper-resistant;

The provision of such a transaction drawer which is provided with a readily graspable handle such that the attendant or clerk within the building may forcefully close and latch the transaction drawer in a relatively short time in an emergency; and The provision of such a transaction drawer which is of rugged and durable construction, which is reliable in operation, which is convenient to use, both to the clerk or attendant and to the customer, which is attractive in appearance, and which has a long service life.

Other objects and features of this invention will be in part apparent and in part pointed out hereinafter.

Briefly stated, a pass-through transaction drawer of the present invention comprises a frame which is adapted to be installed in the opening in the wall of a building or the like with the frame including a runway extending into the building. A drawer is movably mounted on the runway and is selectively movable by an attendant or clerk within the building between a retracted (or closed) position in which the drawer is within the building and in which the opening in the wall of the building is closed, and an extended (or open) position in which the drawer projects out beyond the wall of the building permitting a customer to have access to the interior of the drawer. The drawer has a relatively deep portion therein for receiving relatively large articles, such as cans of oil, beverage packages, or the like, and a relatively shallow deal tray carried by the transaction drawer above the relatively deep portion. The deal tray is removable from the drawer by the attendant when the drawer is in its retracted position thereby to enable the attendant to place the relatively large items within the deep portion of the drawer and, when the drawer is in its extended position, to permit a customer to remove the larger items.

BRIEF DESCRIPTION OF THE DRAWINGS

Corresponding reference characters indicate corresponding parts throughout the several view of the drawings.

DESCRIPTION OF A PREFERRED EMBODIMENT

Figure 1:
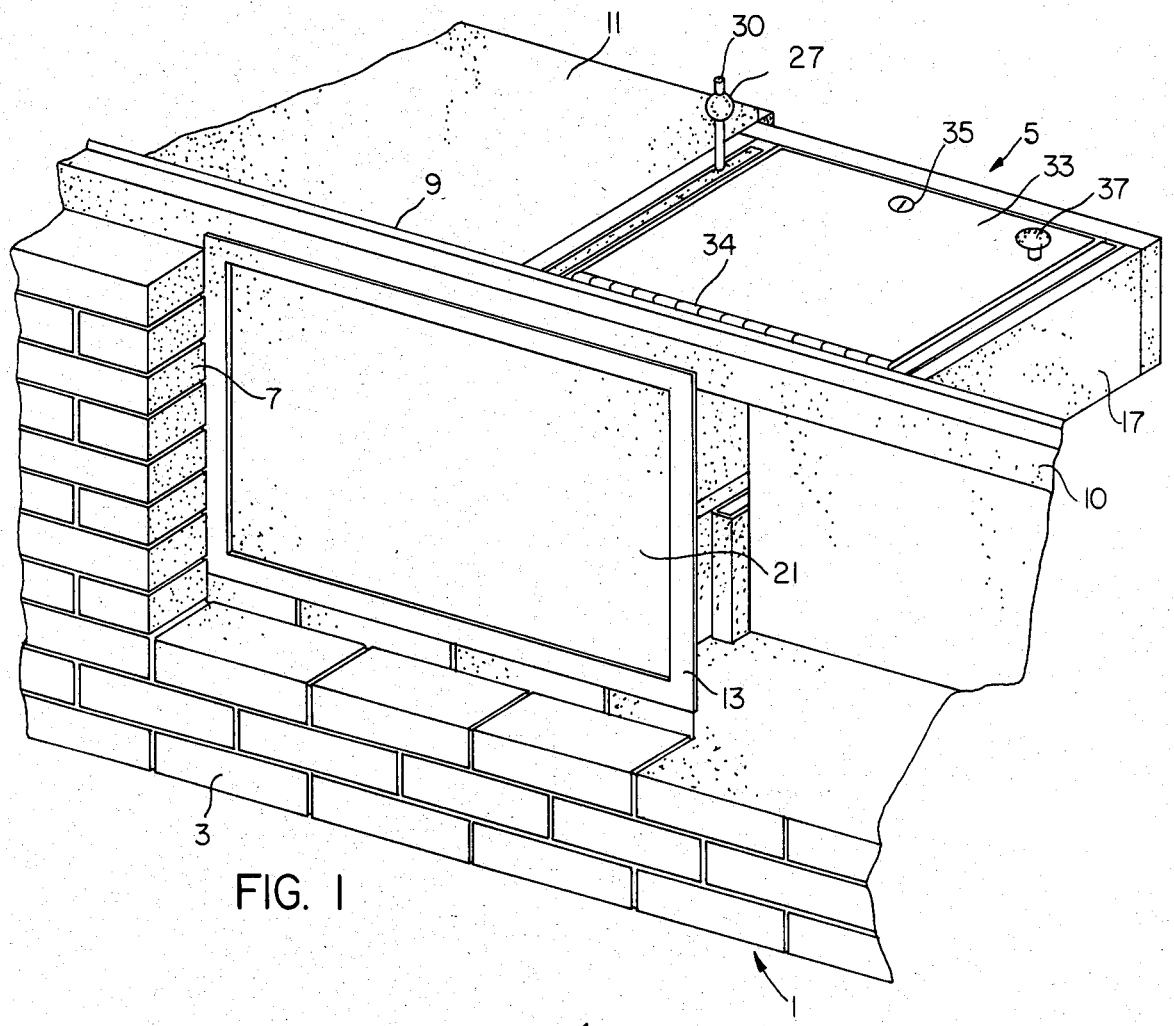
FIG. 1 is a perspective view of the outer wall of a building, such as a self-serve service station attendant's booth, a walk-up bank teller window, or the like, having an opening therein with a window above the opening and with a pass-through transaction drawer of the present invention installed within the opening below the window so as to permit transactions between the attendant within the building and a customer on the outside of the building, the transaction drawer being shown in its retracted or closed position.

Referring now to the drawings, a building, as generally indicated at 1, is shown to have an outside wall 3 with a transaction drawer 5 of the present invention installed within an opening 7 through the wall of the building. A window 9 is typically located above the transaction drawer, with the lower edge of the window being mounted in a window mullion 10. Such buildings may, for example, include an attendant's building located on a service island of a self-service gasoline station, or a walk-up teller's window at a bank, or a walk-up window at an all-night convenience food store or the like. The transaction drawer 5 of the present invention permits an attendant, teller, or clerk within the building to view customers through the window 9 and to transact business with the customers via the transaction drawer by exchanging money, credit cards, change, and articles between the attendant and the customer without permitting access by the customer to the cash register or cash box within the building, and while maintaining the attendant or clerk within the relative security of a locked building.

As further shown in FIG. 1, a counter 11 may be provided adjacent transaction drawer 5 on which credit card machines, cash registers, or the like may be conveniently located for use by the attendant or clerk. Further, the opening 7 through building wall 3 typically has an exterior opening frame 13 mounted therewithin for mounting the transaction drawer 5 within the opening. A weather gasket 15 is provided on frame 13 such that the opening 7 will be sealably closed when the transaction drawer is closed thereby keeping the interior of building 1 relatively free of drafts, rain, and the like.

Figure 2:
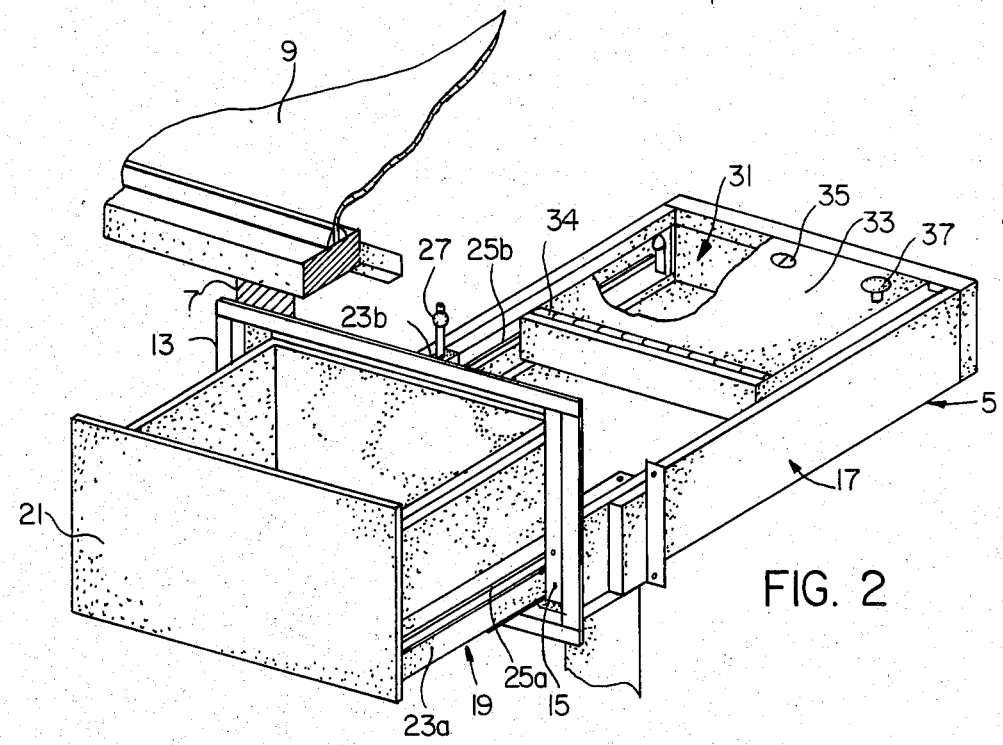
FIG. 2 is a view similar to FIG. 1, with portions of the building and window broken away, and with the drawer in its extended or open position with a shallow so-called deal tray removed from the movable drawer so as to permit the exchange of relatively large articles, such as cans of oil or six-packs of beverage cans.
Figure 3:
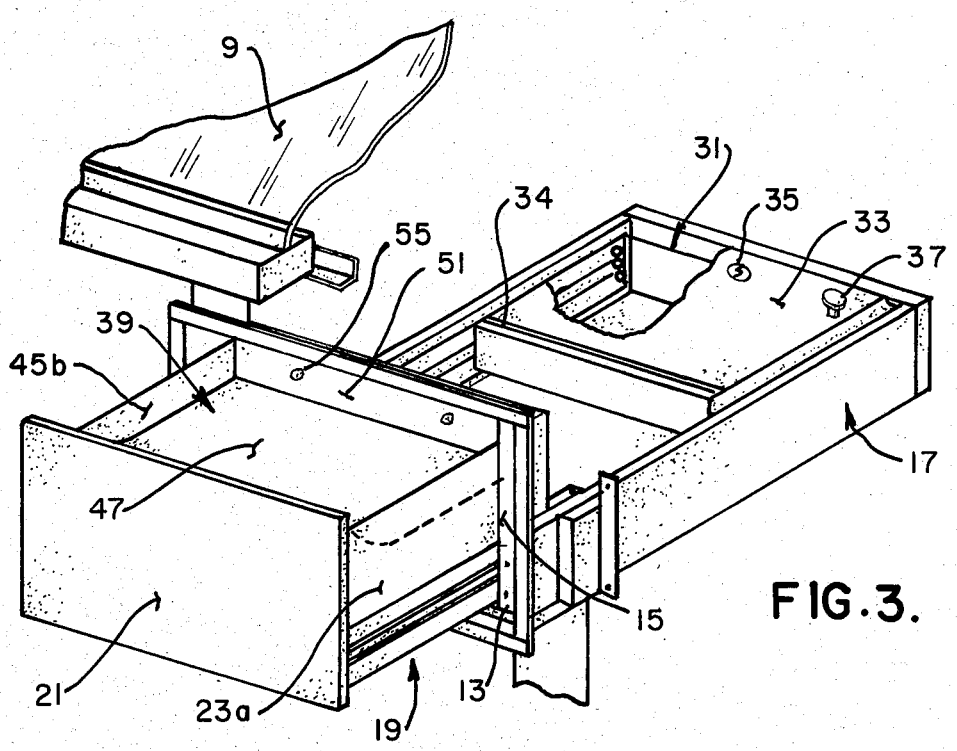
FIG. 3 is a view similar to FIG. 2, illustrating the relatively shallow depth deal tray in place on top of the relatively deep transaction drawer thereby to more readily facilitate the transfer of cash, credit cards, and small articles.

Transaction drawer 5 further includes a drawer housing or runway 17 solidly mounted relative to frame 13 and to counter 11 thereby to positively mount the transaction drawer 5 relative to the building. Transaction drawer 5 includes a movable, relatively deep drawer, as generally indicated at 19, movable relative to the drawer housing 17 between a retracted or closed position (as shown in FIG. 1) in which the attendant within the building 1 has access to the movable drawer, and an extended or open position, as generally shown in FIG. 2, in which the movable drawer portion extends out beyond frame 13 such that a customer on the exterior of the building has access to the contents of drawer 19. In this manner, by moving the drawer between its opened and closed positions, the customer and the attendant may readily transact business, transfer money and credit cards, and transfer packages between the interior and exterior of the building, without permitting the customer access to the interior of the locked building in which the attendant and the cash register are housed.

More specifically, movable drawer 19 is provided with a drawer front 21 which, when the movable drawer is closed, closes opening 7 and sealably engages weather gasket 15. As will be noted in FIG. 1, when the drawer is in its closed position, it has a relatively tight, recessed fit relative to frame 13 thereby to render the drawer relatively tamper-resistant. Drawer 19 further includes drawer sides **23*a*, 23*b*, and a floor (not shown). Track means 25*a*, 25*b* are provided on each of the drawer sides 23*a*, 23*b*, respectively, with these track means fitting into other track means (not shown) provided within drawer runway 17 thereby to permit the ready movement of the movable drawer 19 between its opened and closed positions. It will be understood that the construction of these track means may be conventional in that the movable drawer 19** may be mounted on ball bearing rollers or the like, thereby to permit the ready extension and retraction of the drawer without binding. Since the exact construction of these tracks and rollers are not, per se, a part of this invention, a complete disclosure of the tracks and the rollers will be omitted for the sake of brevity.

Figure 9:
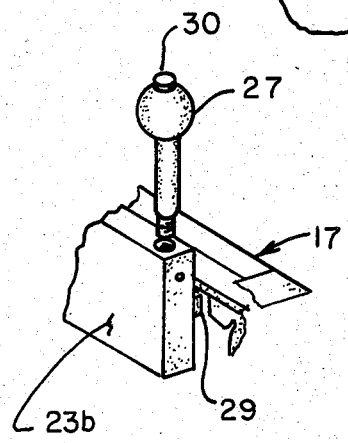
FIG. 9 (sheet 2) illustrates the details of a handle and latch arrangement for permitting a clerk or attendant within the building to readily open and close the transaction drawer and to automatically lock or latch the transaction drawer in its closed position.

Further, the rearward portions of one of the drawer sides (e.g., drawer side **23*b*) is provided with a drawer handle 27 which may be readily grasped by the attendant within the building to extend and to retract the movable drawer. Additionally, handle 27 is provided with a so-called panic latch mechanism (as shown in FIG. 9), which automatically latches the drawer in its retracted or closed position as the drawer is closed. An unlocking pushbutton 29 is provided on the top of drawer handle 27 so as to permit the attendant to readily unlock or unlatch the drawer, so as to enable the attendant to extend the drawer when desired. Further details of the construction of this latching mechanism will be described hereinafter in relation to FIG. 9**.

Figure 4:
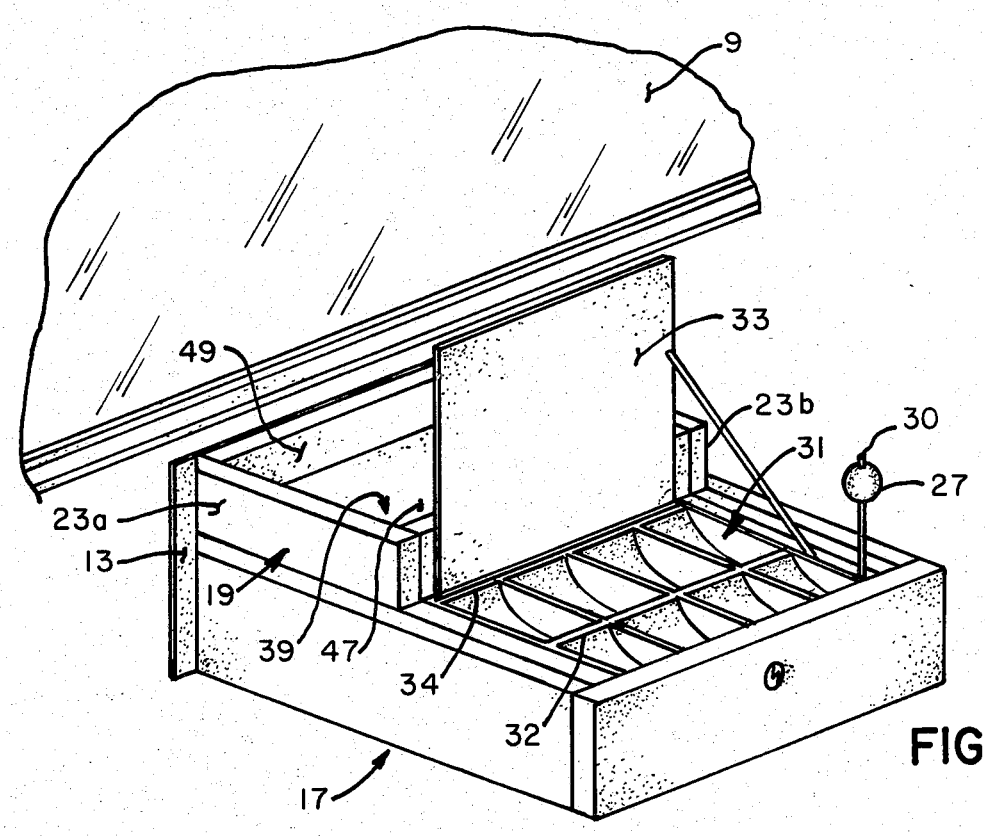
FIG. 4 is a perspective view of the transaction drawer in its closed or retracted position, as viewed from the interior of the building, showing a cash box located within the transaction drawer at the rear of the movable drawer with the lid to the cash box in its open position thus concealing contents of the cash box from a customer on the outside of the building.
Figure 5:
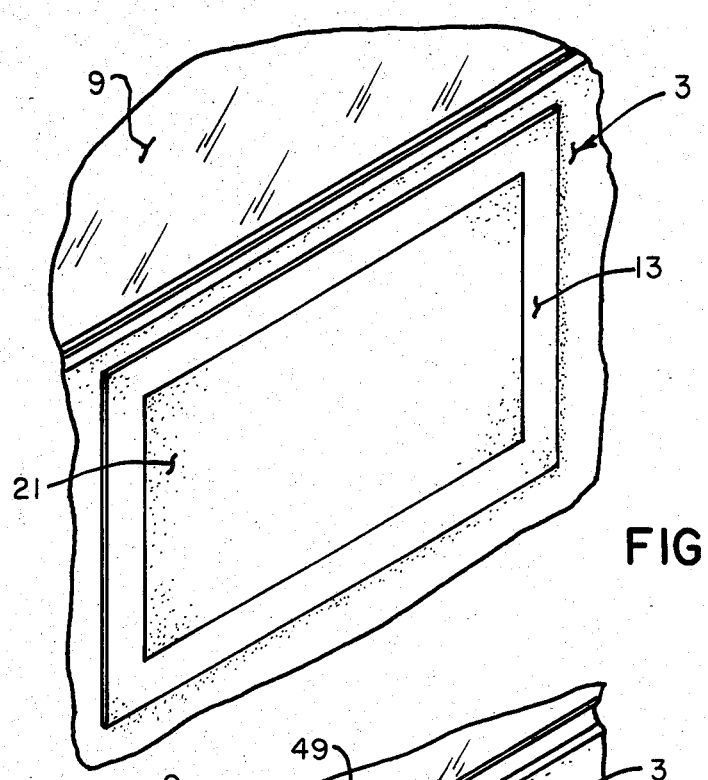
FIG. 5 is a perspective view of a portion of the exterior wall of the building, showing the transaction drawer in its closed position, with the front wall of the transaction drawer being substantially flush relative to the wall of the building and sealably closing the opening in the wall against the weather and providing a substantially tamper-resistant opening for the transaction drawer.
Figure 6:
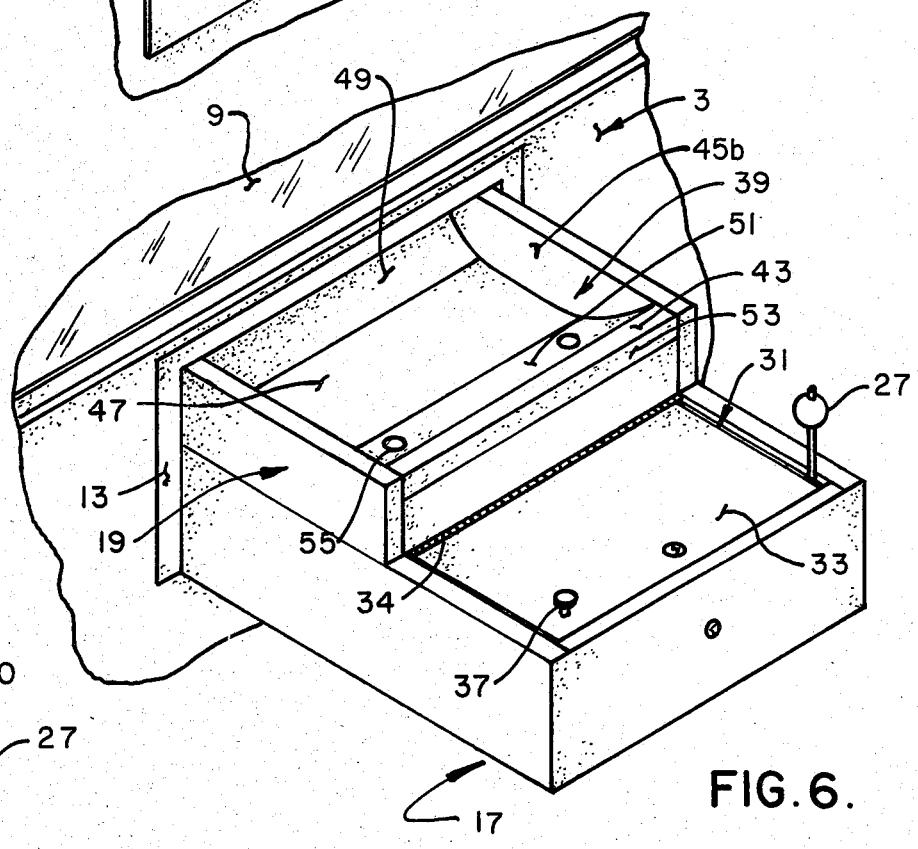
FIG. 6 is a view similar to FIG. 4, with the lid of the cash box closed and with details of the relatively shallow transaction drawer being more clearly illustrated.

Transaction drawer 5 may optionally include a cash box, as generally indicated at 31, at the rear of movable drawer 19. As shown best in FIG. 4, the cash box may include a plurality of bill and coin receptacles 32 therewithin for holding various currency and coin denominations. The cash box is provided with a lid 33 hinged relative to the transaction drawer runway by an elongate hinge 34 extending transversely between the sides of the drawer runway at the forward end of the lid (i.e., at the end of the lid closest to window 9) so that with the lid in its raised position, as shown in FIG. 4, a customer on the outside of building 1 would have his view of the contents of the cash box substantially hidden by the raised lid. Further, a lock 35 and a handle 37 may be provided for the cash box lid.

As heretofore mentioned, movable drawer 19 is of relatively deep (e.g., perhaps 8½ inches high × about 14 inches wide), so as to transfer can goods, quarts of motor oil, and beverage packages. In accordance with this invention, the movable, relatively deep drawer 19 is provided with a relatively shallow, removable deal tray, as generally indicated at 39, which may be readily inserted onto the top surfaces of movable drawer 19 or removed therefrom only by the attendant or clerk within the building. This relatively shallow deal tray facilitates transactions involving only the exchange of money or credit cards, and small articles (e.g., a package of cigarettes or the like), these money and credit card transactions typically accounting for the majority of the transactions at self-service gasoline stations, bank teller windows, and the like. Thus, the provision of the removable deal tray 39 provides a dual capability for the transaction drawer 5 of the present invention in that it readily facilitates the transfer of cash and credit sales, and yet, when necessary, permits the transfer of relatively large, bulky items via the deep movable drawer 19.

Figure 8:
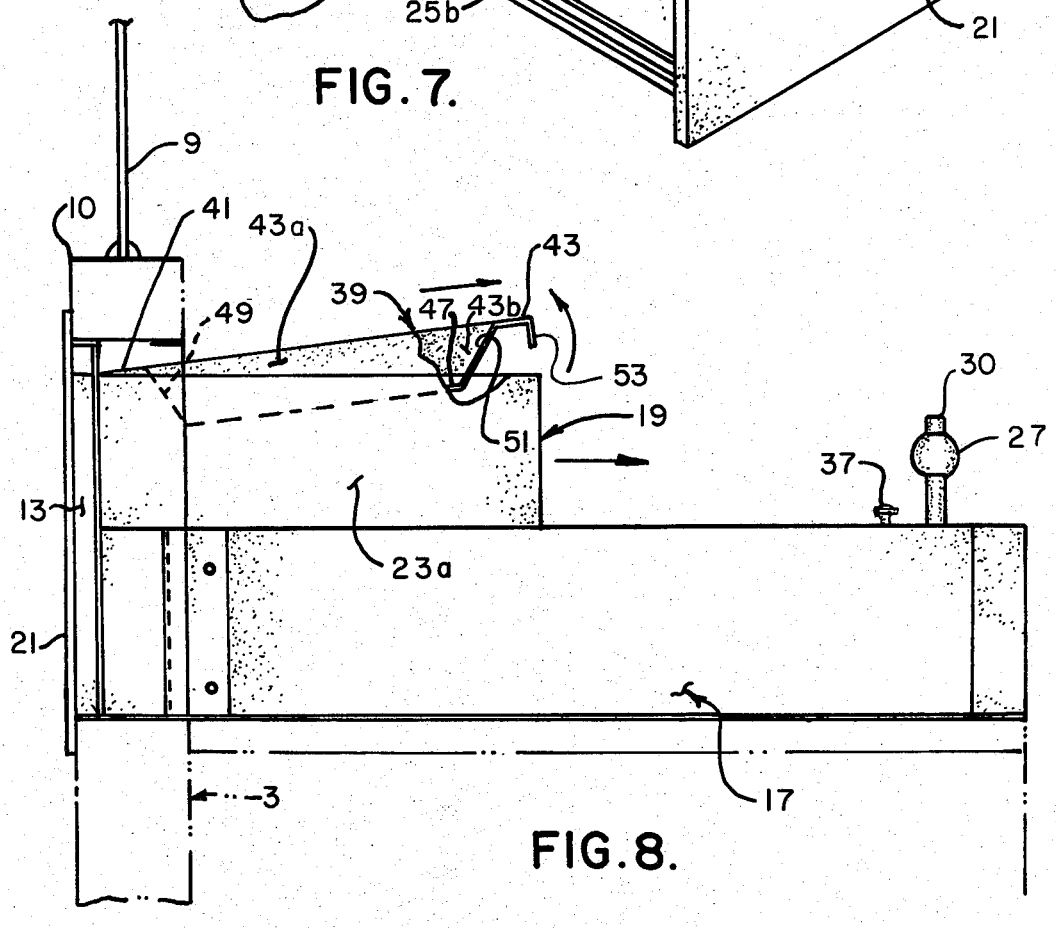
FIG. 8 is a right side elevational view of the transaction drawer, generally as it is shown in FIG. 1, illustrating the manner in which the relatively shallow deal tray is removed from and inserted into the movable deep drawer.

As best shown in FIG. 8, deal tray 39 is preferably formed of rugged sheet metal construction of stainless steel or the like. The deal tray typically has a front, generally horizontal flange 41 which rests on a front, upwardly facing transverse surface of movable drawer 19 adjacent drawer front 21. The deal tray further has a rear, generally horizontal flange 43, which rests on the rear transverse surface of the movable drawer. The deal tray has sides 45*a*, 45*b* which extend downwardly and which loosely fit between the drawer sides 23*a*, 23*b* of the movable drawer. A floor 47 closes the bottom of the tray and typically provides a maximum depth for the deal tray of about three inches, which may be substantially less than the depth of the movable drawer 19 which may, for example, have a height or depth of about eight and one-half inches. Further, deal tray 39 is provided with a front inclined wall 49 interconnected front flange 41 and the front edge of floor 47, and a rear inclined wall 51 which interconnects the rear edge of floor 47 and the rear flange 43. Additionally, a lip 53, for purposes as will appear, extends generally perpendicularly downwardly from rear flange 43 and is engageable with the outer face of the rear wall of movable drawer 19. Further, finger holes 55, located in the inclined rear wall 51, permit the attendant within the building to readily, manually grasp the deal tray to remove it and insert it from and into movable drawer 19 when it is desired to exchange relatively large articles.

As can be seen in FIG. 8, for removal of deal tray 39 from movable drawer 19, the attendant or clerk places his fingers in finger holes 55 and lifts the rear end of the drawer upwardly, rotating the drawer on front flange 41 until such time as the downwardly extending lip 53 is clear of the rear end of drawer 19, and until such time as the deal tray floor 47 is clear of the back wall of drawer 19. Then, the deal tray may be readily slid upwardly and rearwardly (as indicated by the arrows in FIG. 8) for removal of the deal tray from the movable drawer. The attendant then may lay the deal drawer on counter 11 adjacent transaction drawer 5 while he completes the transaction, such as by placing the larger articles (e.g., a can of oil or the like) in the relatively deep drawer 19, moving the drawer to its extended position thereby giving access to the interior of the drawer and to the article therein by the customer on the outside of building 1. Upon retracting the drawer 19, the attendant may readily replace deal tray 39 by lifting the deal tray and inserting the forward end into drawer 19 such that front flange 41 bears on the front edge of the drawer and by lowering the deal tray such that rear flange 43 bears on the upper rear portion of the drawer such that flange 43 is adjacent the outer back face of the drawer.

Figure 7:
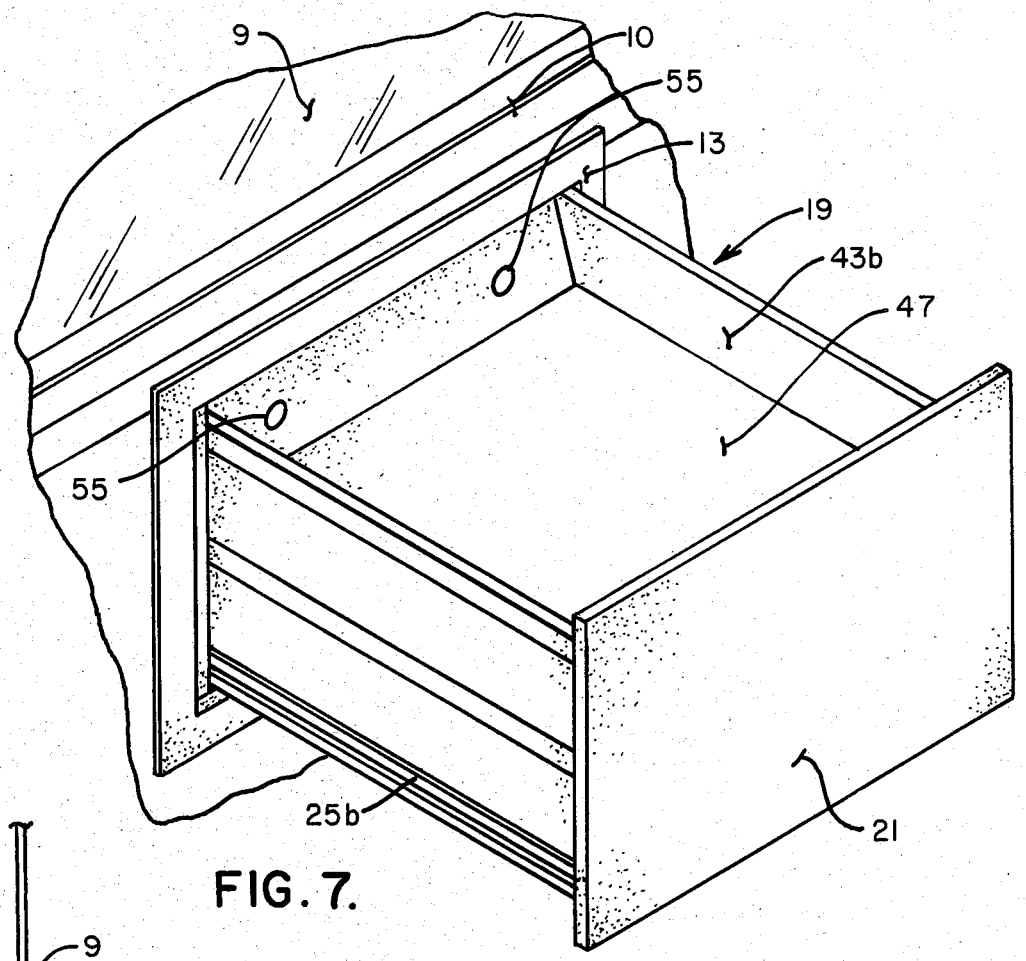
FIG. 7 is another perspective view of the transaction drawer from the exterior of the building with the transaction drawer in its extended or open position with the deal tray in place.

In accordance with this invention, it will be appreciated with transaction drawer 5 in its extended position (as shown in FIG. 7), it is a relatively difficult matter for a customer on the outside of building 1 to obtain an adequate grip on transaction drawer 39 so as to lift its front end up from drawer 19. However, even if the customer were able to do this, the fact that flange 53 bears against the rear of drawer 19 prevents the customer on the outside of the building from moving the drawer forwardly. Also, the relatively low clearance between the window mullion 10 and drawer frame 13 and together the upper surfaces of the transaction drawer (as best shown in FIG. 8) prevent the deal drawer from being rotated upwardly any significant degree by a person standing on the outside of the building. In this manner, it will be appreciated that it is a relatively easy manner for the attendant within the building to remove or to replace the deal drawer, but yet it is relatively difficult for a customer on the outside of the building to remove the deal tray. Additionally, if a customer would attempt to remove the deal tray, the attendant within the building may readily grasp handle 29 and forceably retract the deal tray and lock the transaction drawer in its retracted position while the attendant remains in the relative security of building 1. Also, if the attendant forceably retracts the drawer in an emergency situation, the attendant's relatively good grasp on handle 27 and the camming action of mullion 10 bearing on a forwardly tilted tray 39 permits the transaction drawer to be readily closed and locked.

In view of the above, it will be seen that the other objects of this invention are achieved and other advantageous results obtained.

As various changes could be made in the above constructions without departing from the scope of the invention, it is intended that all matter contained in the above description or shown in the accompanying drawing shall be interpreted as illustrative and not in a limiting sense.

What is claimed is:

1. A transaction drawer, comprising:

a frame adapted to be installed in an opening in the wall of a structure, said frame including a runway extending into the structure;

a drawer movably mounted on said runway and being selectively movable by an attendant within said structure between at least a first retracted position in which said drawer is within said structure such that said opening is closed, and a second extended position in which said drawer projects out beyond the wall of the structure permitting a customer on the outside of the structure to have access to the interior of the drawer, said drawer having a relatively large depth dimension for receiving relatively large items along said interior;

a deal tray carried by said drawer, said deal tray having a relatively shallow depth, said deal tray being mounted to close the interior of said drawer, said deal tray being removable from said drawer by the attendant when said drawer is in the retracted position, said deal tray including means for preventing removal of said deal tray by a person on the outside of said building when said drawer is in its extended position, said means for preventing removal of said deal tray from said drawer including a downwardly extending lip on the attendant side of said deal tray engageable with said drawer so as to prevent relative forward movement of said deal tray with respect to said drawer, and means at the opening of said structure coacting with the lip of said transaction drawer to prevent upward movement of said deal tray in the extended position of said drawer; and a cash box mounted on the inner end of said runway, said cash box being disposed rearwardly of said drawer when said drawer is in its first position, said cash box having a depth dimension substantially less than the depth dimension of said drawer so that said cash box is at least partially blocked from view from the customer side of said structure when said drawer is in its first position.

2. The transaction drawer set forth in claim 1 wherein said deal tray has a front and a relatively shallow floor, said front and rear of said deal tray bearing on respective upwardly facing surfaces of said drawer, said deal tray having means for permitting said deal tray to be readily removed from and inserted into said drawer by an attendant within said building.

3. The transaction drawer of claim 2 wherein said cash box further includes a lid hinged relatively to said runway for swinging between an open and closed position with said hinge access extending generally transversely of said drawer such that when said lid is in its raised position, said lid substantially blocks the view of the cash box from the outside of said building even in both the first and second positions of said cash box.

4. The transaction drawer of claim 3 further including a handle for permitting the relative movement of said drawer between the first and second positions of said drawer, said handle including means for automatically locking said drawer in its retracted position.

5. A transaction drawer, comprising:

a frame;

a drawer movably mounted on said frame between at least a first position and a second position, said drawer having a relatively deep portion for receiving a first size item;

a tray mounted over the deep portion of said drawer and adapted to close said deep portion, said tray having a portion for receiving a second size item, said tray being removable in only one of the first and second positions of said drawer said tray having a front wall, a rear wall, and a bottom wall, said front and rear walls of said tray bearing on respective upwardly facing surfaces of said drawer;

means associated with said tray to prevent its removal in the first and second positions of said drawer, said last mentioned means including a downwardly extending lip on the rear of said tray engageable with said drawer so as to block forward relative movement of the tray with respect to said drawer; and a cash box, said cash box being disposed rearwardly of said drawer when said drawer is in its first position, said box being mounted along the depth of said box so that said cash drawer is at least partially blocked from view in the first position of said drawer.

6. The transaction drawer of claim 5 wherein said frame is adapted to be installed in an opening in a wall of an enclosure, said drawer being selectively movable by an attendant within said enclosure between said first and said second positions, said tray being removable by said attendant in said first position, said drawer being cooperatively engageable with at least a portion of said frame in the other of said first and second positions to prevent removal by a customer external to said enclosure.

* * * * *